US011796181B2

(12) United States Patent
Kim et al.

(10) Patent No.: US 11,796,181 B2
(45) Date of Patent: Oct. 24, 2023

(54) ELECTRIC RANGE

(71) Applicant: LG ELECTRONICS INC., Seoul (KR)

(72) Inventors: Seunghak Kim, Seoul (KR); Junghyeon Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 50 days.

(21) Appl. No.: 17/512,165

(22) Filed: Oct. 27, 2021

(65) Prior Publication Data

US 2022/0178548 A1 Jun. 9, 2022

(30) Foreign Application Priority Data

Dec. 7, 2020 (KR) ..... 10-2020-0169421

(51) Int. Cl.

| | |
|---|---|
| ***F24C 7/06*** | (2006.01) |
| ***F24C 7/08*** | (2006.01) |
| ***F24C 15/12*** | (2006.01) |

(52) U.S. Cl.

CPC ..... *F24C 7/067* (2013.01); *F24C 7/082* (2013.01); *F24C 7/087* (2013.01); *F24C 15/12* (2013.01)

(58) Field of Classification Search

CPC ..... F24C 15/12; F24C 7/067; F24C 7/082; F24C 7/087; H05B 6/1263; H05B 2206/022

See application file for complete search history.

(56) References Cited

U.S. PATENT DOCUMENTS

2007/0278215 A1 12/2007 Schilling et al.
2008/0185376 A1* 8/2008 Gagas ..... H05B 6/1263 219/623

FOREIGN PATENT DOCUMENTS

EP 3 076 754 A1 10/2016
EP 3 651 550 A1 5/2020
JP 2012052685 A * 3/2012

* cited by examiner

*Primary Examiner* — Thien S Tran
(74) *Attorney, Agent, or Firm* — Bryan Cave Leighton Paisner LLP

(57) ABSTRACT

An electric range includes a case and a cover plate coupled to an upper surface of the case to place an object. Further, the electric range includes a plurality of heating portions disposed below the cover plate to heat the object and an upper bracket disposed under the heating portion to support the heating portion a control board disposed between the cover plate and the upper bracket. Furthermore, the electric range includes a support member having a first end disposed under the control board and a second end disposed on the upper bracket to support the control board and a base bracket disposed under the upper bracket and comprising a printed circuit board.

19 Claims, 12 Drawing Sheets

ELECTRIC RANGE

CROSS-REFERENCE TO RELATED APPLICATION

This application claims priority to and the benefit of Korean Patent Application No. 10-2020-0169421, filed on Dec. 7, 2020, which is hereby incorporated by reference as if fully set forth herein.

TECHNICAL FIELD

The present disclosure relates to an electric range, and one particular implementation relates to an induction heating type electric range.

BACKGROUND

The content described in this section merely provides background information on the present disclosure and does not explain the related art.

Various types of cooking appliances may be used to heat food at home or in a restaurant. For example, a cooking appliance may include a gas range using gas and an electric range using electricity. Also, an electric range may use a resistance heating method and an induction heating method.

An electrical resistance method may generate heat by applying electric current to a non-metallic heating element such as a metallic resistance wire or silicon carbide, and may radiate or conduct the generated heat to heat an object (e.g., a cooking vessel such as a pot or a frying pan).

An induction heating method may apply high-frequency power to a coil to generate a magnetic field around the coil and heat an object to be heated made of metal using an eddy current generated from the magnetic field. Thus, when electric current is applied to a working coil or a heating coil, heat is generated by induction and may heat the object.

The brackets that support various components of an electric range may have a plate-shaped structure, and the plate-shaped structure may become deformed due to the load of the components thereof or an external force. Therefore, developing a structure capable of increasing rigidity of the brackets may be needed.

An electric range may include a control board that is electrically connected to a printed circuit board. The control board may receive an operation command from a user for the electric range. Since the control board may include a circuit board and a circuit element, a malfunction may occur when the control board is heated.

Therefore, a structure capable of or configured for providing an air flow space around the control board may be needed to suppress malfunction that may occur due to the heating of the control board. In addition, a support structure capable of or configured for stably supporting the control board may be needed.

SUMMARY

According to an embodiment of the present disclosure, an electric range may cool a control board by providing an air flow space at or near an arrangement portion of the control board may be provided.

According to an embodiment of the present disclosure, an electric range stably supporting a control board inside an upper bracket may be provided.

According to an embodiment of the present disclosure, an electric range adhering to the control board to a cover plate may be provided.

According to an embodiment of the present disclosure, an electric range may include a support member having a first end disposed under or below a control board and a second end disposed on an upper bracket and may be configured to support the control board.

The control board may define or include a first mounting protrusion that protrudes from a front side and a rear side of the control board. A plurality of support members may be provided and a first mounting protrusion may have a number corresponding to the number of the plurality of support members.

The first mounting protrusion may include a first mounting hole to receive an upper portion of the support member. The first upper plate may include a second mounting hole at a position corresponding to a position of the first mounting hole and the second mounting hole may receive a lower portion of the support member.

According to an embodiment, the support member may include a rod and a first elastic member. The rod may have an upper surface disposed under the control board and a lower surface disposed on the upper bracket. With this exemplary structure, the upper surface of the rod may support the control board and the rod may be supported by the upper bracket.

A first elastic member may be inserted into the rod, may be disposed at a circumference of the rod, and may have one side contacting the bottom surface of the upper bracket. The first elastic member may be provided as, for example, a coil spring. The first elastic member may elastically support the rod.

The first elastic member may apply pressure to the rod to push the rod upward, and accordingly, the control board coupled to the rod may also be pressed or pushed upward and may be adhered to the cover plate.

The rod may include a body, a head, a first stopper, a second stopper, and a first groove. When the rod is disposed on the upper bracket and the control board, the longitudinal or axial body is disposed in a vertical direction to provide a space between the first upper plate of the upper bracket and the control board in the vertical direction of the electric range.

According to another embodiment, the support member may include a second elastic member that is integrally formed and at least a portion of the second elastic member is elastically deformed. The second elastic member may include a first mounting portion, an elastically deforming or deformable portion, and a second mounting portion.

A plurality of second elastic members may be provided. The control board may include a second mounting protrusion that protrudes from each of a first side and a rear or second side of the control board and to dispose the second mounting portion. The number of second mounting protrusions may correspond to the number of second elastic members.

A first side of the second elastic member may be disposed under the control board and a second side of the second elastic member may be disposed on the first upper plate of the upper bracket. The second elastic member may elastically support the control board. The second elastic member may press the control board to adhere the control board to the cover plate and stably maintain the adherence state.

According to an embodiment, an electric range may include a case; a cover plate coupled to an upper surface of the case and configured to place or receive an object; a plurality of heating portions, disposed under the cover plate, and configured to heat the object; an upper bracket disposed under the heating portion and configured to support the heating portion; a control board disposed between the cover plate and the upper bracket; a support member having a first end disposed under the control board and a second end disposed on the upper bracket and configured to support the control board; and a base bracket disposed under the upper bracket and including a printed circuit board.

A plurality of support members may be provided, the control board may define a first mounting protrusion that protrudes from each of a front side and a rear or second side of the control board, and the first mounting protrusion may include a first mounting hole to receive an upper portion of the support member The upper bracket may include: a first upper plate that forms a bottom surface of the upper bracket; and a second upper plate bent from an edge of the first upper plate, the first upper plate may include a second mounting hole at a position corresponding to a position of the first mounting hole and the second mounting hole may receive a lower portion of the support member.

The support member may include: a rod having an upper surface disposed under or below the control board and a lower surface disposed on the upper bracket; and a first elastic member mounted at the rod, disposed at a circumference of the rod, and having one side contacting the bottom surface of the upper bracket.

The first elastic member may be provided as a coil spring.

The rod may include a body; a head disposed on the body and that protrudes in a direction crossing a longitudinal direction of the body; a first stopper disposed under the head and arranged in the direction crossing the longitudinal direction of the body; a second stopper disposed at a lower portion of the body and arranged in the direction crossing the longitudinal direction (or radial direction) of the body; and a first groove formed by recessing the body in the longitudinal direction (or radial direction) of the body from the head and configured to divide the head and the first stopper.

The support member may include a second elastic member that is integrally formed and at least a portion of the second elastic member may be elastically deformed.

The second elastic member may include a first mounting portion received in a through-hole of the upper bracket; an elastically deforming portion connected to the first mounting portion and having at least one bending portion; and a second mounting portion connected to the elastically deforming portion and disposed at an end of the control board.

The first mounting portion may include a first cell provided in pair and having a first side or one of the pair of first cells received in the through-hole; and a second cell connecting second side or one of the pair of first cells.

The elastically deforming portion may include a first piece connected to one side of the second cell; a second piece having a first side connected to a second side of the first piece and bent in a direction inclined from the first piece; and a third piece having one end connected to the second side of the second piece and bent from the second piece in a direction parallel to the first piece.

The second mounting portion may include a first strip bent from the third piece in a horizontal direction; a second strip bent from the first strip in a vertical direction; and a third strip bent from the second strip in the horizontal direction.

The electric range in one embodiment of the present disclosure may include the support member adhering to the control board to the cover plate disposed above the upper bracket, thereby providing a sufficient air flow space under the control board. With the air flow space, heat applied to the control board may be effectively cooled.

In addition, for the electric range in the embodiment, the support member may stably adhere the control board to the cover plate.

Aspects, features, and advantages of the present disclosure are not limited to those described above. It is understood that other aspects, features, and advantages not mentioned above can be clearly understood from the following description and can be more clearly understood from the embodiments set forth herein. Additionally, it is understood that various aspects, features, and advantages described herein can be realized via means and combinations thereof that are described in the appended claims.

BRIEF DESCRIPTION OF THE DRAWINGS

The accompanying drawings constitute a part of the specification and illustrate one or more embodiments in the disclosure, and together with the specification, explain the disclosure.

DETAILED DESCRIPTION

Figure 1:
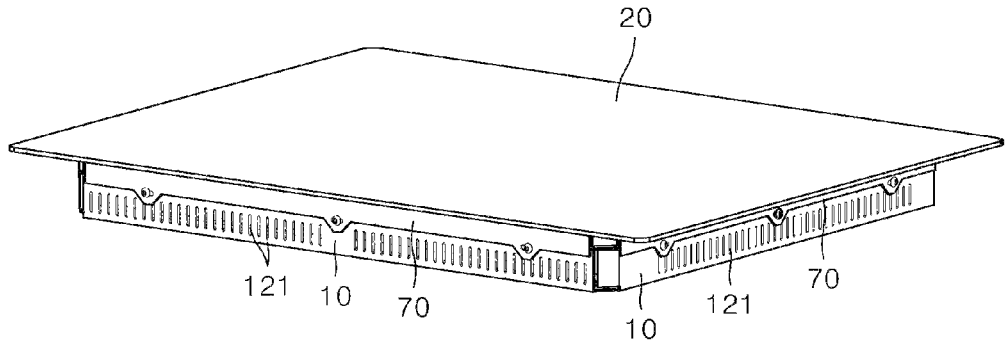
FIG. 1 is a perspective view of an example electric range according to an embodiment of the present disclosure.

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to a person skilled in the relevant art and having possession of this disclosure, are to be considered within the scope of the invention.

The terms "first", "second" and the like are used herein only to distinguish one component from another component. Thus, the components should not be limited by the terms. Certainly, a first component can be a second component unless stated to the contrary.

Throughout the disclosure, each component can be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary Throughout the disclosure, "a vertical direction" refers to a vertical direction of an electric range when the electric range is disposed for normal use. "A horizontal direction" refers to a direction orthogonal to the vertical direction, and a forward and rearward direction refers to a direction orthogonal to both the vertical direction and the horizontal direction. "Bilateral direction" or "a lateral direction" has the same meaning as the horizontal direction, and these terms may be used interchangeably herein.

Various terminology used herein can imply direct or indirect, full or partial, temporary or permanent, action or inaction. For example, when an element is referred to as being "on," "connected" or "coupled" to another element, then the element can be directly on, connected or coupled to the other element or intervening elements can be present, including indirect or direct variants. In contrast, when an element is referred to as being "directly connected" or "directly coupled" to another element, there are no intervening elements present.

Figure 2:
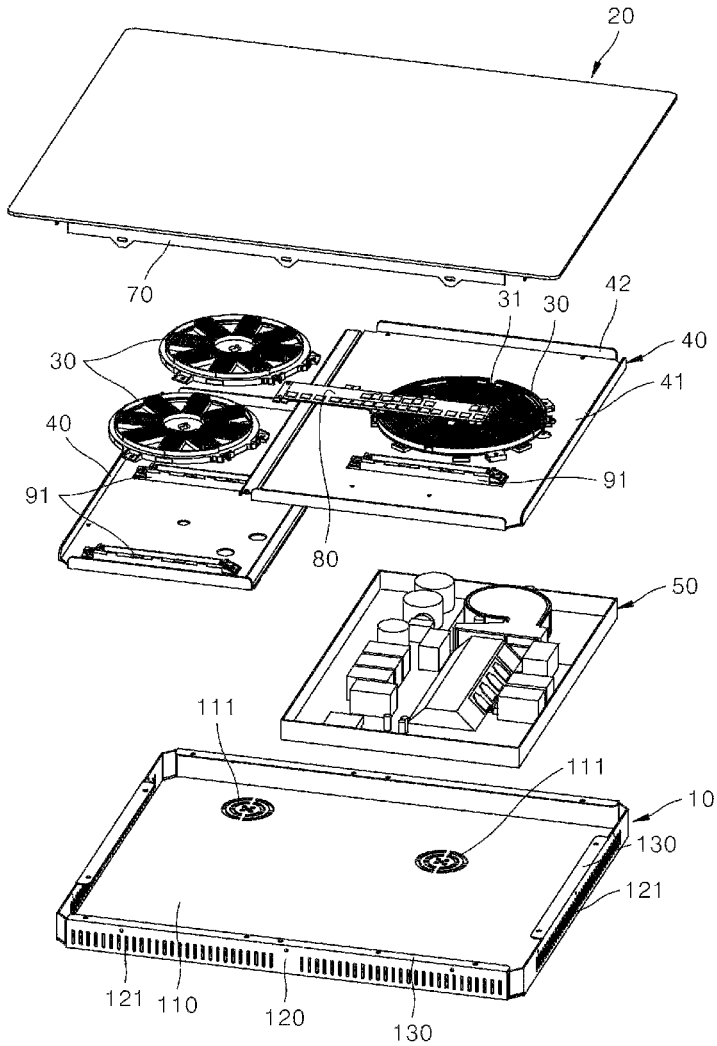
FIG. 2 is an exploded perspective view of an example electric range according to an embodiment of the present disclosure.

FIG. 1 is a perspective view of an electric range according to an embodiment of the present disclosure. FIG. 2 is an exploded perspective view of an example electric range according to an embodiment of the present disclosure.

The electric range according to an embodiment of the present disclosure may heat an object using an induction heating method. In this example, the object may be, for example, a dish made of metal such as stainless steel or iron.

According to an embodiment of the present disclosure, an induction heating method may include a method of generating a magnetic field around a working coil 31 by applying high-frequency power to the working coil 31 and heating an object made of metal using an eddy current caused by the generated magnetic field.

For example, a heating portion 30 may include the working coil 31 disposed adjacent to a ferrite core 330. The heating portion 30 may apply high-frequency power to the working coil 31 to generate a magnetic field around the working coil 31, and when an object is placed in or near a region of the generated magnetic field, an eddy current caused by the magnetic field may flow through the object to cause Joule heating, thereby heating the object. Depending on the object (e.g., a dish or the like) being heated, food contained in the object may be heated and cooked accordingly.

According to an embodiment of the present disclosure, an electric range may include a case 110, a cover plate 20, a heating portion 30, an upper bracket 40, and a base bracket 50.

The case 10 may protect components of the electric range. For example, the case 10 may be made of aluminum, but is not limited thereto.

The case 10 may be thermally insulated to suppress heat generated by the working coil 31 from being emitted to outside.

The case 10 may accommodate various components of the electric range of the present disclosure. For example, as the components of the electric range may include the heating portion 30, the working coil 31, the upper bracket 40, and a control board 80, but not limited thereto. The case 10 may include an upper surface configured to define an opening, and the opening thereof may be closed by the cover plate 20. The case 10 may have a cubical or box like shape (or any other suitable shape), which may be formed by processing the plate material.

The case 10 may include a first casing 110, a second casing 120, and a third casing 130.

The first casing 110 may be configured to define a bottom surface of the case 10. The first casing 110 may support inner components of the electric range.

The first casing 110 may be configured to accommodate a printed circuit board 51 and may include at least one ventilation hole 111 through which air flows or communicates to facilitate cooling of the circuit element components placed on the printed circuit board 51.

The second casing 120 may be bent from the first casing 110 and may define a side surface of the first casing 110. The second casing 120 may be bent from an edge of the first casing 110 in a vertical direction and may define the side wall of the electric range according to an embodiment of the present disclosure. The second casing 120 may surround the side wall of the base bracket 50.

The second casing 120 may be disposed on each of sides of the first casing 110 having a substantially quadrangular or rectangular shape. The second casing 120 may reinforce the rigidity of the casing 10.

That is, the second casing 120 bent from the first casing 110 may be configured to suppress the plate-shaped first casing 110 from being curved (or deformed) or damaged by the weight of the internal components thereof or an external force.

The second casing 120 may further include a plurality of exhaust holes 121 defining slits. The plurality of exhaust holes 121 communicates air to flow from inside of the case 10 to outside of the case 10 to flow air through the exhaust hole 121, thereby cooling the components accommodated in the case 10.

The third casing 130 may be bent from the second casing 120 and may support the upper bracket 40. The third casing 130 may be disposed on each side of the first casing 110.

A first upper plate 41 may be placed or disposed on a top surface of the third casing 130, forming a bottom surface of the upper bracket 40, and may be coupled to the third casing 130 by a coupling mechanism such as a bolt, but not limited thereto.

The cover plate 20 may be coupled to the top surface of the case 10 and may be configured to receive an object to be heated. The cover plate 20 may be configured to close an opening disposed on the top side opposite the bottom surface of the case 10 to protect the components accommodated in the case 10.

The object to be heated may be placed on the top surface of the cover plate 20, and the magnetic field generated by the heating portion 30 may pass through the cover plate 20 to reach the object to be heated. The cover plate 20 may be made of, for example, material including ceramic, but is not limited thereto.

An input interface may be disposed on the top surface of the cover plate 20 to receive an input from a user. The input interface may be disposed in an area of the top surface of the cover plate 20 and may display an image.

The input interface may receive a touch input from the user, and an electric range according to an embodiment of the present disclosure may be driven based on the received touch input from the user.

For example, the input interface may be a module to input a heating intensity or heating time desired by the user and may be provided as a physical button or a touch panel.

For example, the input interface may be a thin film transistor liquid crystal display (TFT LCD), but is not limited thereto.

The control board 80 may be disposed under the cover plate 20 to input one or more operation commands to an electric range according to an embodiment of the present disclosure. The control board 80 may be disposed between the cover plate 20 and the upper bracket 40.

The control board 80 may include a plurality of key switches, and a user may control the operation of the electric range by inputting one or more commands to the control board 80 using the key switches.

In an electric range according to an embodiment of the present disclosure, the top surface of the control board 80 may be disposed under the bottom surface of the cover plate 20. In this example, the control board 80 may be provided or disposed at a position corresponding to the input interface.

The control board 80 and the input interface may communicate with each other by a capacitive touch input method. Accordingly, when a user inputs the control command to the input interface, the control command may be input to the control board 80.

In addition, a display may be disposed in an area of the top surface of the cover plate 20 to indicate a driving state of the electric range. It is understood that the display is not limited to any specific location.

According to an embodiment of the present disclosure, a light display area may be provided on the top surface of the cover plate 20. A light source portion 91 may be disposed below the cover plate 20 and emit light to transmit the light to the user through the light display area. In this example, the light display area and the light source portion 91 may be provided at positions corresponding to each other. In one example, when a plurality of light source portions 91 are provided, the same number of light display areas may be provided on the top surface of the cover plate 20.

According to an embodiment of the present disclosure, an electric range according may include a cover bracket 70 to support the cover plate 20. The cover bracket 70 is described hereinafter with reference to FIGS. 2, 4, and 5.

The cover bracket 70 may be disposed outside of each of the upper bracket 40 and the case 10, may be coupled to the case 10, and support the cover plate 20. For example, the cover bracket 70 may be coupled to the case 10 by a coupling mechanism such as the bolt, but not limited thereto.

A plurality of cover brackets 70 may be provided and each of the plurality of cover brackets 70 may be provided at each side of the quadrangular or rectangular cover plate 20. Accordingly, four cover brackets 70 may be disposed on the sides of the quadrangular or rectangular cover plate 20.

The cover bracket 70 may include a first cover plate 710 and a second cover plate 720. The first cover plate 710 may face the second casing 120 and may be coupled to the second casing 120. The second cover plate 720 may be bent from the first cover plate 710 and may support the cover plate 20.

The cover plate 20 may be placed or disposed on the top surface of the second cover plate 720, and the second cover plate 720 and the cover plate 20 may be coupled to each other by, for example, an adhesive. However, the method of coupling the second cover plate 720 and the cover plate 20 is not limited to a method using the adhesive.

According to an embodiment of the present disclosure, a plurality of heating portions 30 may be provided or disposed under the cover plate 20, and may be configured to heat an object. In an embodiment, the heating portion 30 may use an induction heating method.

In another embodiment, some of the plurality of heating portions 30 may use an induction heating method and the rest thereof may use an electric resistance heating method to be provided as a highlight heating device. The electric range with such structure may be referred to as "a hybrid range".

Hereinafter, an electric range including the plurality of heating portions 30 using the induction heating method is described in accordance with embodiments of the present disclosure.

In one embodiment, the heating portion 30 may be disposed on the upper bracket 40. For example, three heating portions 30 may be provided. The number of heating portions 30 is not limited thereto. In one example, when the plurality of heating portions 30 are provided, a plurality of upper brackets 40 configured to support the heating portions 30 may also be provided in accordance with the number of the heating portions 30.

The heating portion 30 may include a core frame 320 and a working coil 31. The working coil 31 may be spirally wound around the top surface of the core frame 320, and a ferrite core 330 may be disposed under the bottom surface of the core frame 320. Accordingly, when high-frequency power is applied to the working coil 31, a magnetic field may be formed around the ferrite core 330, and the formed magnetic field may cause an eddy current to flow through an object to be heated.

The heating portion 30 is described in detail below with reference to the drawings of the present disclosure.

Figure 3:
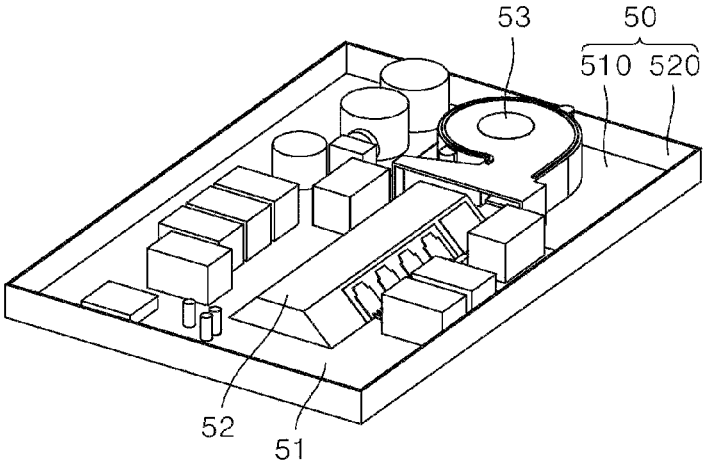
FIG. 3 is a perspective view of examples of an base bracket and components placed on the upper bracket according to an embodiment of the present disclosure.
Figure 4:
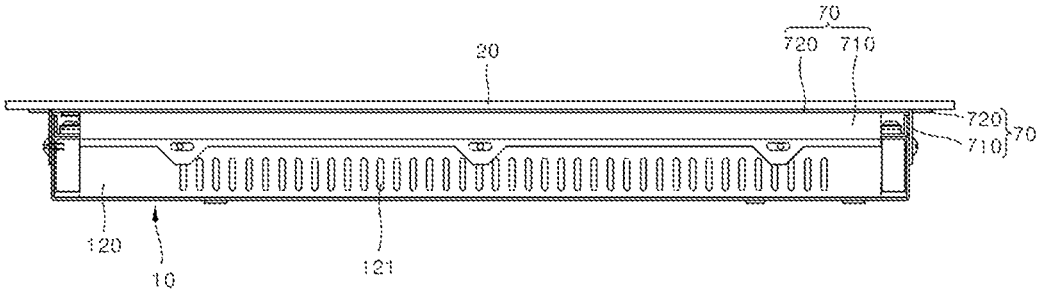
FIG. 4 is a front view of an example electric range according to an embodiment of the present disclosure.

FIG. 3 is a perspective view of examples of an base bracket 50 and components placed on the upper bracket 40. FIG. 4 is a front view of an example electric range.

Figure 5:
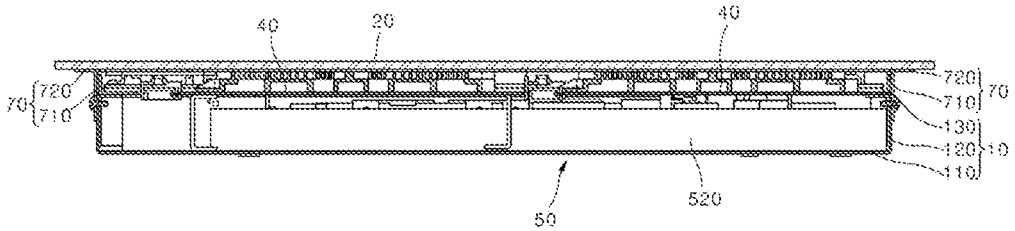
FIG. 5 is a cross-sectional view of the electric range according to an embodiment shown in FIG. 4.
Figure 6:
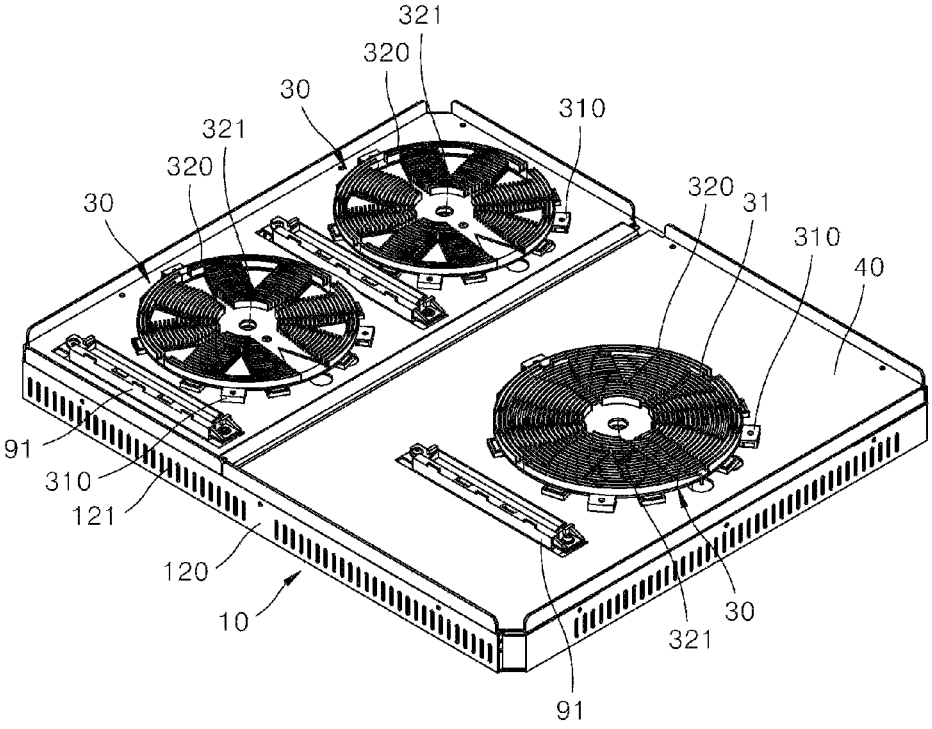
FIG. 6 is a perspective view of the electric range according to an embodiment shown in FIG. 1, and for clarity of description and illustration some components are omitted.

FIG. 5 is a cross-sectional view of the electric range in FIG. 4. FIG. 6 is a perspective view of the electric range of FIG. 1 with some components omitted for clarity of description and illustration.

The upper bracket 40 may be disposed under a heating portion 30 and may be configured to support the heating portion 30. In an embodiment, a plurality of upper brackets 40 may be provided. The upper bracket 40 may be made of, for example, aluminum, but is not limited thereto.

The upper bracket 40 may include a first upper plate 41 and a second upper plate 42. The first upper plate 41 may be provided or configured to form a bottom surface of the upper bracket 40 and may be configured to place the heating portion 30.

The first upper plate 41 may be configured to cover the top of a printed circuit board 51 disposed below the first upper plate 41. In one embodiment, when a plurality of upper brackets 40 are provided, a first upper plate 41 may cover the printed circuit board 51. Alternatively, a plurality of first upper plates 41 may be coupled to each other to cover the printed circuit board 51 corresponding to the size of the printed circuit board 51.

With this exemplary structure, the first upper plate 41 may block an electromagnetic field and electromagnetic waves generated from the heating portion 30 from reaching the printed circuit board 51 and the elements placed or disposed on the printed circuit board 51.

That is, the upper bracket 40 may improve electromagnetic compatibility (EMC) and electromagnetic interference (EMI) performance of the printed circuit board 51.

The second upper plate 42 may be bent from the first upper plate 41 in or toward the vertical direction of the electric range. The second upper plate 42 may be bent from an edge of the first upper plate 41 in the vertical direction.

The second upper plate 42 may be disposed on each of sides of the first upper plate 41 having a substantially quadrangular or rectangular shape. In one embodiment, when a plurality of upper brackets 40 are provided, the second upper plate 42 may be disposed on each of side of the first upper plate 41 except for adjacent sides of the first upper plates 41 where adjacent upper brackets 40 may be coupled to each other.

The second upper plate 42 may reinforce the rigidity of the upper bracket 40. That is, the second upper plate 42 bent from the first upper plate 41 may suppress the plate-shaped first upper plate 41 from being curved or damaged by the weight of the inner components (e.g., the heating portion 30) or an external force.

According to an embodiment of the present disclosure, a light source portion 91 may be disposed on the upper bracket 40. For example, the light source portion 91 may be disposed on the printed circuit board 51 provided below the upper bracket 40, and the upper bracket 40 may define or include an opening at a position corresponding to the light source portion 91. In another embodiment, the light source portion 91 may be disposed on the upper bracket 40 and may be electrically connected to the printed circuit board 51 provided below the upper bracket 40.

In one embodiment, a light display area may be disposed on the cover plate 20 at a position corresponding to the light source portion 91.

The light source portion 91 may include, for example, a plurality of LEDs arranged in a line. The light source portion 91 may be turned on when the heating portion 30 is operated and may inform the user the operating state of the heating portion 30. Alternatively, the light source portion 91 may inform the user the operation state of the electric range by changing a lighting pattern and/or the color of the plurality of LEDs.

The number of light source portions 91 may be appropriately selected according to the number of heating portions 30. In FIG. 6, three light source portions 91 are provided for three heating portions 30. However, the number of light source portions 91 is not limited thereto.

The base bracket 50 may be disposed under the upper bracket 40 and may be configured to receive or mount the printed circuit board 51 thereon. Additionally, the base bracket 50 may include a bottom plate 510 and a side plate 520. The bottom plate 510 may be provided or disposed to form a bottom surface of the base bracket 50 and may be configured to receive or mount the printed circuit board 51 on the top surface thereof.

The side plate 520 may be bent from the bottom plate 510 in the vertical direction of the electric range of the present disclosure. The side plate 520 may be bent from an edge of the bottom plate 510 in the vertical direction.

The side plate 520 may be disposed on each side of the bottom plate 510 having a substantially quadrangular or rectangular shape. In one embodiment, when a plurality of upper brackets 40 are provided, side plates 520 may be disposed on each side of the bottom plate 510 except for the adjacent sides where the upper brackets 40 may be coupled adjacent to each other.

The side plate 520 may reinforce rigidity of the base bracket 50. That is, the side plate 520 bent from the bottom plate 510 may suppress the plate-shaped bottom plate 510 from being curved (or deformed) or damaged due to the weight of internal components such as a circuit board or an external force.

The printed circuit board 51 may include a controller. The printed circuit board 51 may receive power from an external power source, and may communicate with an external device by wire or wirelessly.

The printed circuit board 51 may be electrically connected to the control board 80 to receive a command input by the user from the control board 80. The printed circuit board 51 may be electrically connected to the light source portion 91 and the working coil 31 to control operations thereof, in accordance with embodiments of the present disclosure.

Referring to FIG. 3, the printed circuit board 51 may include an electric circuit and may be configured to receive or mount an active element and a passive element including, for example, a heat sink 52 and a blowing fan 53.

The heat sink 52 may cool the heat inside of the case 10 to protect the components accommodated or disposed in the case 10. The heat sink 52 may be disposed on the printed circuit board 51 and may cool the heat generated at or near the circuit board. In addition, the heat sink 52 may cool the heat generated by the heating portion 30 due to the electromagnetic interactions on the circuit board.

For example, the heat sink 52 may include a plurality of cooling fins and an air guide configured to cover the cooling fins and to guide air to flow to the cooling fins.

The blowing fan 53 may be disposed on the printed circuit board 51. As shown in FIG. 3, a guide wall may be disposed at an air discharge outlet of the blowing fan 53 to guide the air forcibly generated by the blowing fan 53 to flow toward the heat sink 52.

For example, when the blowing fan 53 is operated, the air inside the case 10 may be forced to flow toward the heat sink 52. Thereby, the heat sink 52 may cool the inside of the case 10.

Figure 7:
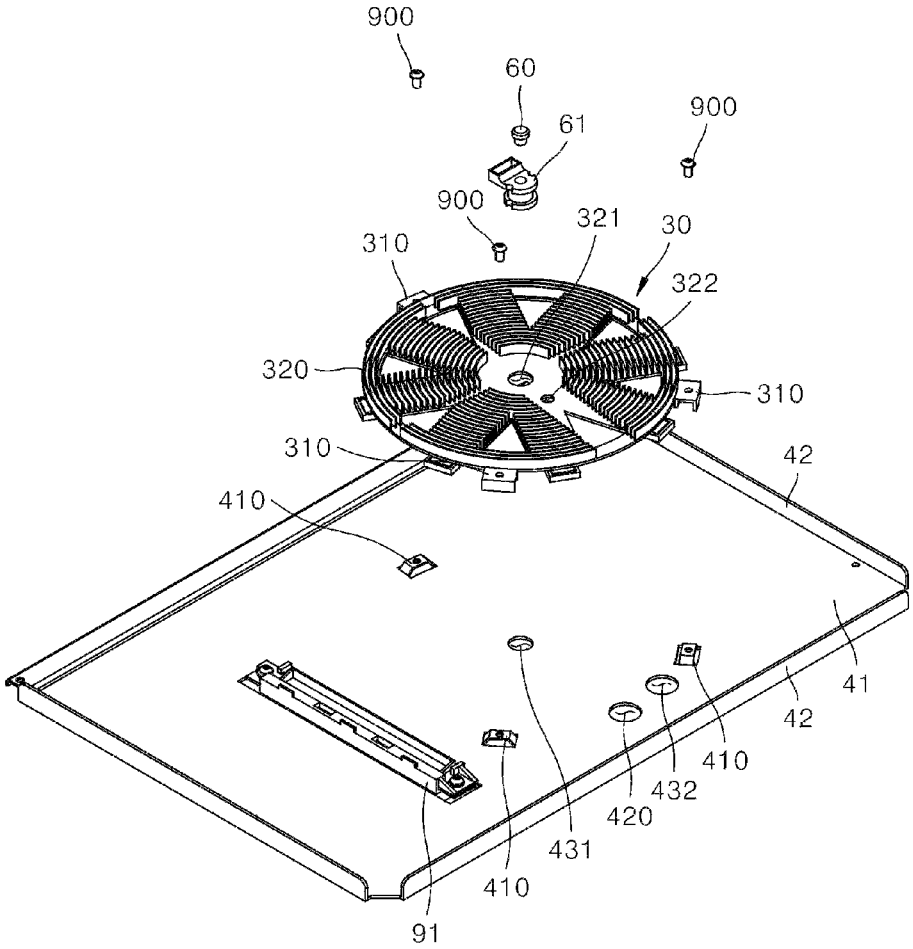
FIG. 7 is an exploded perspective view of some components of the electric range according to an embodiment shown in FIG. 6.
Figure 8:
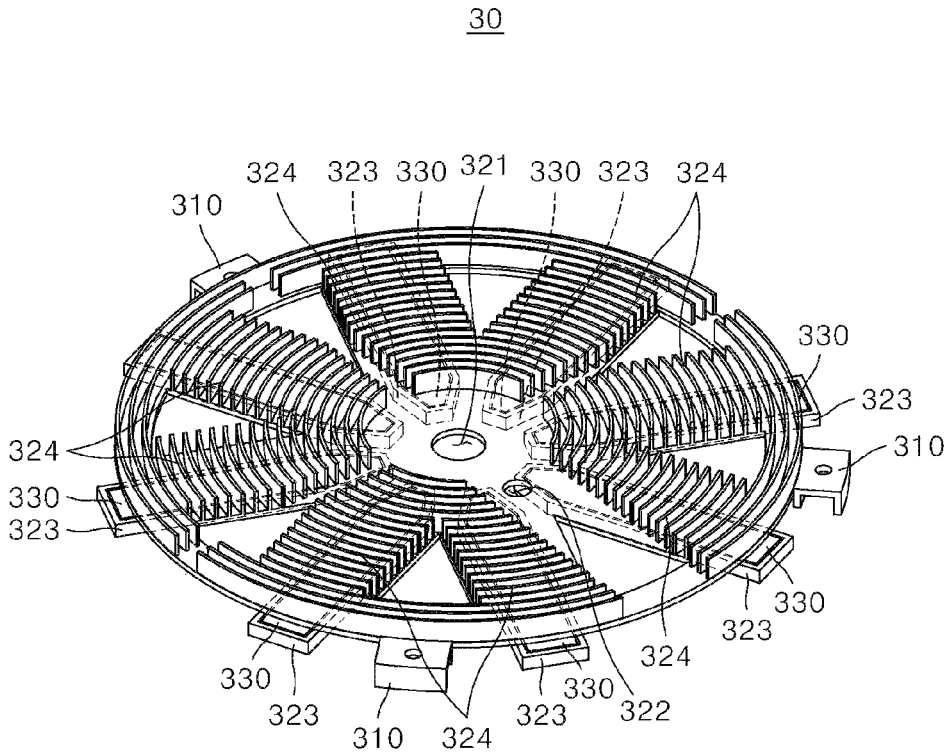
FIG. 8 is a perspective view of an example heating portion according to an embodiment of the present disclosure.

FIG. 7 is an exploded perspective view of some exemplary components of the electric range in FIG. 6. FIG. 8 is a perspective view of an example heating portion 30. For clarity of description and illustration, the working coil 31 is omitted in FIGS. 7 and 8.

The heating portion 30 and an upper bracket 40 may include couplers at positions corresponding to each other to place or mount the heating portion 30 on the upper bracket 40.

The upper bracket 40 may include a first coupler 410 that protrudes from the upper bracket 40 and may be configured to couple to the heating portion 30. The heating portion 30 may include a second coupler 310 corresponding to the first coupler 410.

A plurality of second couplers 310 may protrude from the outer circumference of the core frame 320, may be radially arranged, and may each be coupled to the corresponding one of the first couplers 410 of the upper bracket 40 by a coupling mechanism.

The plurality of second couplers 310 may be provided, may be disposed at an edge of the heating portion 30, may be spaced apart from one another in a circumferential direction, and may be arranged radially. The number of the first couplers 410 may be the same as the second couplers 310, and the second coupler 310 may be disposed on the upper bracket 40 at the position corresponding to the first coupler 410.

The first coupler 410 and the second coupler 310 may be coupled to each other by fastening, for example, with a screw bolt 900, but not limited thereto.

The electric range according to the embodiment of the present disclosure may further include a temperature sensor 60 disposed at a central portion of the core frame 320. The core frame 320 may include a sensor mounting hole 321 at the central portion thereof to receive or mount the temperature sensor 60 thereon.

The temperature sensor 60 may be electrically connected to the printed circuit board 51 disposed below the upper bracket 40 by a cable or wire. For the electric connection, the cable may pass through the upper bracket 40 to connect the temperature sensor 60 and the printed circuit board 51. To facilitate passage or penetration, the upper bracket 40 may include a cable insertion hole 420 to insert the cable connected to the temperature sensor 60 through the insertion hole 420.

In an embodiment, the electric range may include a sensor bracket 61 to couple the temperature sensor 60 to the core frame 320. The sensor bracket 61 may receive the temperature sensor 60, and the temperature sensor 60 may be detachably inserted into the sensor mounting hole 321.

The temperature sensor 60 may measure the temperature of the heating portion 30 during operation of the electric range. In one embodiment, the heating portion 30 may be operated by an induction heating method of the present disclosure. The heating portion 30 may generate heat by electromagnetic interaction.

The heat generated by the heating portion 30 may adversely affect the heating portion 30, the printed circuit board 51 disposed below the heating portion 30, and various other elements placed or mounted on the printed circuit board 51. Therefore, the electric range may need to measure a temperature of the heating portion 30 to take appropriate measures based on whether the temperature of the heating portion 30 exceeds a set or predetermined value.

The controller of the printed circuit board 51 may receive information on the temperature of the heating portion 30 measured by the temperature sensor 60. Based on whether the temperature of the heating portion 30 exceeds a set or predetermined value, the controller may be configured to stop the operation of the electric range or may be configured to control the blowing fan 53 to increase the cooling capacity thereof.

The core frame 320 may include a first insertion hole 322 to insert a working coil 31 disposed on the core frame 320. The first insertion hole 322 may be defined or disposed at the central portion of the core frame 320 and may be spaced apart from the sensor mounting hole 321 in a radial direction thereof.

Additionally, the first insertion hole 322 may be defined at a separation portion between neighboring guide lines 323*b*. That is, the first insertion hole 322 may be defined or disposed on the core frame 320 at a position having a predetermined distance away from the ferrite core 330.

The working coil 31 may be introduced to the top surface of the central portion of the core frame 320 through the first insertion hole 322. Further, the working coil 31 may be spirally wound around guide rails 324 disposed on the top surface of the core frame 320, and then may be withdrawn to outside of the core frame 320 when the winding reaches an edge at the circumference or perimeter of the core frame 320.

The working coil 31 may be electrically connected to the printed circuit board 51 disposed below the upper bracket 40. For the electrical connection, the upper bracket 40 may include insertion holes to insert the working coil 31.

The insertion holes may include a second insertion hole 431 and a third insertion hole 432. The working coil 31 may be inserted through the second insertion hole 431 and may be introduced into the core frame 320. After winding on the guide rails 324, the working coil 31 may be withdrawn from an edge of the core frame 320 and may be inserted into the third insertion hole 432.

The third insertion hole 432 may be appropriately disposed adjacent to the edge of the core frame 320 to dispose the working coil 31.

The working coil 31 may be introduced into the central portion of the core frame 320 and may be wound around the guide rails 324 in a direction toward the edge at the circumference or perimeter of the core frame 320. The working coil 31 may then be withdrawn from the core frame 320 at the edge of the core frame 320.

Accordingly, the third insertion hole 432 may be appropriately defined or disposed in the upper bracket 40 at a position corresponding to an edge at the circumference or perimeter of the core frame 320 to facilitate placement of the working coil 31 in the electric range of the present disclosure.

The working coil 31 may pass through the second insertion hole 431 of the upper bracket 40 from the printed circuit board 51 and may be introduced onto the top surface of the central portion of the core frame 320 through the first insertion hole 322.

The working coil 31 may move toward the edge of the core frame 320 while being spirally wound around the guide rails 324 disposed on the top surface of the core frame 320, and may be eventually withdrawn to the outside of the core frame 320.

The working coil 31 withdrawn outside of the core frame 320 may pass through the third insertion hole 432 of the upper bracket 40 and may be connected to the printed circuit board 51 again.

Hereinafter, the heating portion 30 is described in detail with reference to FIG. 8.

The heating portion 30 may include a working coil 31, a core frame 320, and a ferrite core 330. In FIG. 8, the working coil 31 is omitted for clarity of description and illustration of the structure of the heating portion 30. However, the heating portion 30 on which the working coil 31 is wound is shown in other drawings to aid understanding the present disclosure.

The working coil 31 may be a Litz wire (but not limited thereto) to generate the magnetic field by receiving high-frequency power.

The ferrite core 330 may be disposed under the bottom surface of the core frame 320 and the working coil 31 may be wound on the top surface of the core frame 320. A plurality of channels 323 may be disposed below the bottom surface of the core frame 320 and may be arranged radially. The ferrite core 330 may be disposed on the plurality of channels 323. Accordingly, the number of channels 323 may be the same as the number of ferrite cores 330.

Each channel 323 may include a mounting groove 323*a* configured to receive the ferrite core 330 and a guide line 323*b* that protrudes from the lower surface of the core frame 320 to define or form the mounting groove 323*a*.

A plurality of guide lines 323*b* may be provided and may be radially disposed under the core frame 320. Additionally, each of neighboring guide lines of the plurality of guide lines 323*b* may be spaced apart from each other in a radial direction at the central portion (or axis) of the core frame 320.

As shown in FIG. 8, the ferrite core 330 may protrude from an edge of the core frame 320 in a radial direction of the core frame 320. In some embodiments, the mounting groove 323*a* may not be provided and only the guide line 323*b* may be provided.

The channel 323 may allow each of a plurality of radially arranged ferrite cores 330 to have a separation distance between each other in the direction around the circumference or perimeter of the core frame 320.

As shown in FIG. 8, the first insertion hole 322 configured to receive the working coil 31 may be defined or disposed between the two neighboring ferrite cores 330 at or near the central portion of the core frame 320. To prevent or suppress interference between the ferrite cores 330 and the first insertion hole 322, the channels 323 disposed adjacent to the first insertion hole 322 may be appropriately spaced apart in radial directions by a distance that is greater than the diameter of the first insertion hole 322 at the central portion of the core frame 30.

The guide rail 324 may be disposed above the ferrite core 330 and the working coil 31 may be wound around the guide rails 324. The guide rails 324 may protrude from the top surface of the core frame 320. The guide rails 324 may have semi-circular (or curved) shapes and may be arranged in radial directions in a concentric manner, and may be configured to guide the working coil 31 placed onto the core frame 320 to be wound spirally.

The guide rails 324 may be provided in radial directions of the core frame 320. The working coil 31 may be received in grooves between the guide rails 324 and may be wound along the guide rails 324 in one or more radial directions.

In order to stably or firmly couple or attach the working coil 31 to the upper surface of the core frame 320, an adhesive may be applied to the guide rail 324 and the grooves between the guide rails 324.

The adhesive may made of thermally insulating material to electrically insulate the working coil 31.

As shown in FIG. 8, the guide rails 324 may be disposed in a consecutive manner along radial directions of the core frame 320. The guide rails 324 may be disposed to substantially cover the corresponding areas opposite to the ferrite cores 330 disposed underneath the bottom surface of the core frame 30.

Additionally, the guide rails 324 may have semi-circular (or curved) shapes and may be arranged in radial directions in a concentric manner, such that the guide rails 324 may be disposed from the central portion of the core frame 320 toward the edge thereof, and the working coil 31 wound around the guide rails 324 may have the spiral shape. Accordingly, the working coil 31 may be disposed beginning from the central portion of the core frame 320 to the edge thereof.

That is, the working coil 31 may be introduced onto the top surface of the core frame 320 through the first insertion hole 322, and may be wound around the guide rails 324. Accordingly, the working coil 31 may have the spiral shape, and may be withdrawn outside of the core frame 320 from the edge of the core frame 320.

The plurality of ferrite cores 330 may be may be placed or disposed on the channels 323, and may be disposed under the core frame 320. The ferrite core 330 may be coupled to the mounting groove 323*a* of the channel 323 by an adhesive. However, the coupling method of the ferrite core 330 is not limited thereto.

In one example, when high-frequency power is applied to the working coil 31, a magnetic field is generated around the ferrite core 330. Thus, an eddy current may be generated in an object that may be placed inside the magnetic field region, and Joule's heat may be generated due to the eddy current to heat the object.

According to an embodiment of the present disclosure, the control board 80 may be disposed on the upper bracket 40. In one example, the control board 80 may be disposed adjacent to the heating portion 30, and the heat generated from the heating portion 30 due to the electromagnetic interactions may be transferred to the control board 80.

Further, the control board 80 may be adhered to the cover plate 20, and the heat transferred to the cover plate 20 from heating the object may flow or transfer to the control board 80. Furthermore, the control board 80 may generate heat based on the operations executed thereof.

As such, the control board 80 may be exposed to significant heat during the operation of the electric range of the present disclosure, and thus, sufficient cooling of the control board 80 may be needed. In one embodiment, to cool the control board 80, a space is provided inside the upper bracket 40 to facilitate air flow through the space and around the control board 80.

The control board 80 may include a structure having a thin or slim shape such that sufficient space is provided or disposed on the upper bracket 40 to facilitate sufficient air flows at or near the area adjacent to the control board 80 to effectively cool the control board 80. As shown in the drawings of the present disclosure, the control board 80 may include a relatively slim or thin plate shape.

In one embodiment, a support structure to stably support the slim control board 80 between the upper bracket 40 and the cover plate 20 may be provided. For example, the support structure may be adhered to the control board 80 to the cover plate 20.

Hereinafter, the support structure to support the control board 80 is described in detail with reference to the drawings of the present disclosure.

Figure 9:
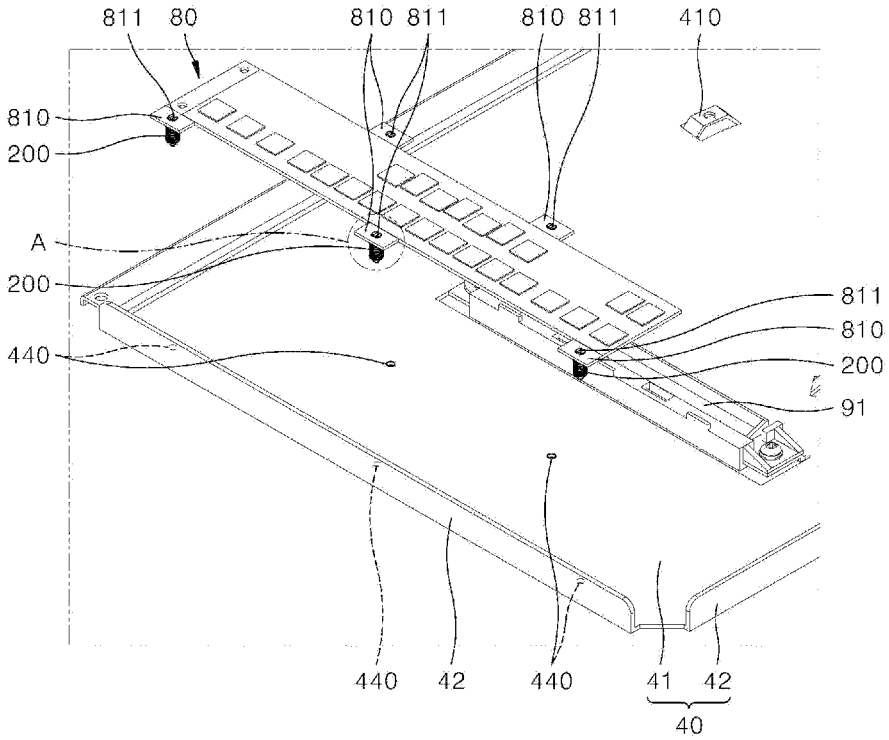
FIG. 9 is a perspective view showing an example coupling structure of a control board according to an embodiment of the present disclosure.
Figure 10:
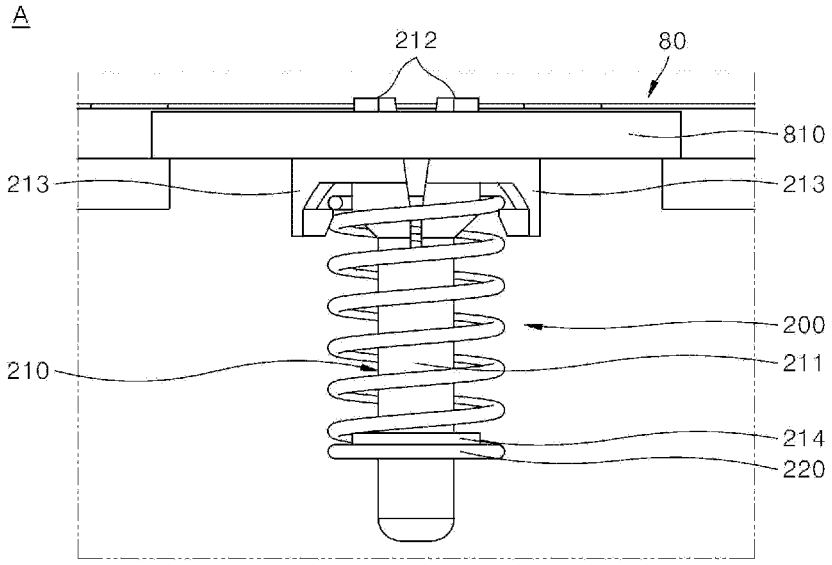
FIG. 10 a perspective view of an example a support member according to an embodiment of the present disclosure.
Figure 11:
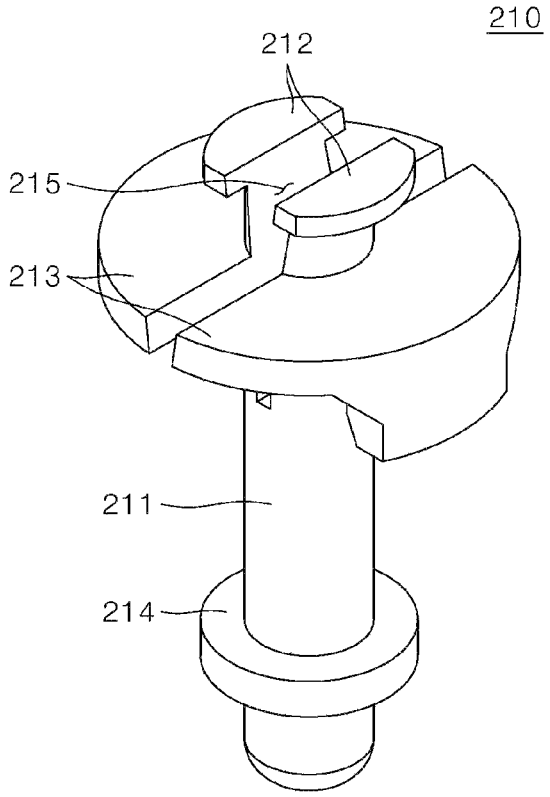
FIG. 11 is a perspective view of an example rod according to an embodiment of the present disclosure.

FIG. 9 is a perspective view showing an example coupling structure of the control board 80. FIG. 10 shows an example support member 200. FIG. 11 is a perspective view of an example rod 210.

Figure 12:
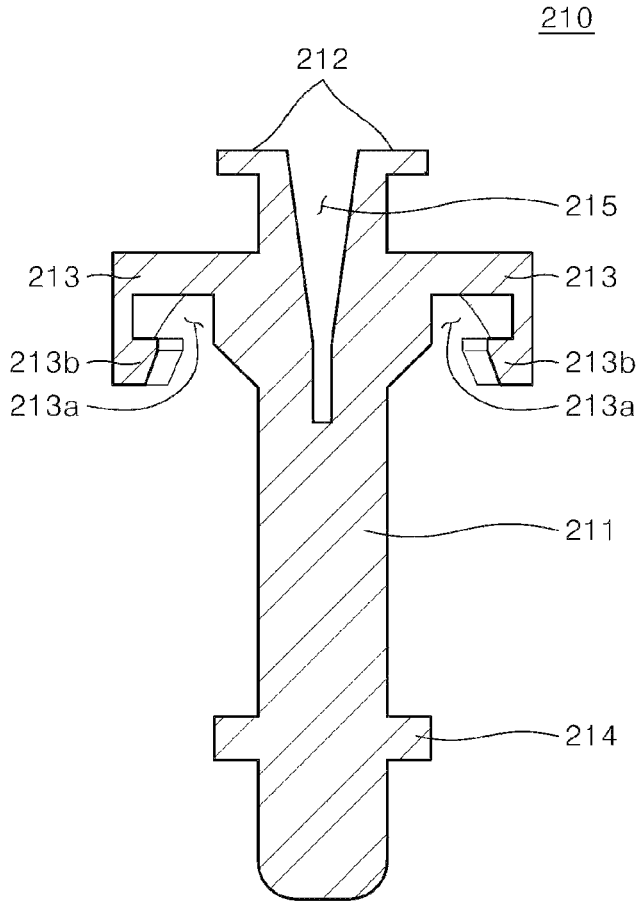
FIG. 12 is a cross-sectional view of the rod according to an embodiment shown in FIG. 11.
Figure 13:
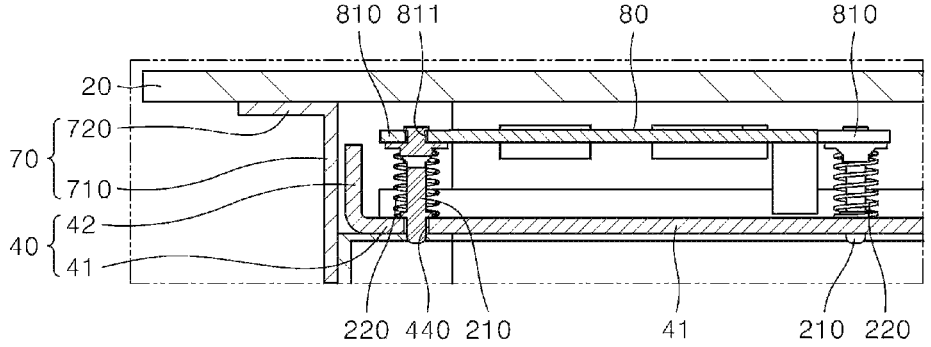
FIG. 13 is a cross-sectional view of an example coupling structure of a control board according to an embodiment of the present disclosure.

FIG. 12 is a cross-sectional view of the rod 210 in FIG. 11. FIG. 13 is a cross-sectional view of an example coupling structure of the control board 80.

An electric range according to an embodiment of the present disclosure may include a support member 200 to support the control board 80. The support member 200 may include a first end disposed under and coupled to the control board 80, a second end disposed on the upper bracket 40. The support member 200 may be disposed on the control board 80 and may be configured to adhere or attach the control board 80 to the cover plate 20.

A plurality of support members 200 may be provided and may be coupled to one or more edges of the control board 80. The control board 80 may define or include a mounting protrusion configured to couple the support member 200 and the control board 80 together.

Figure 14:
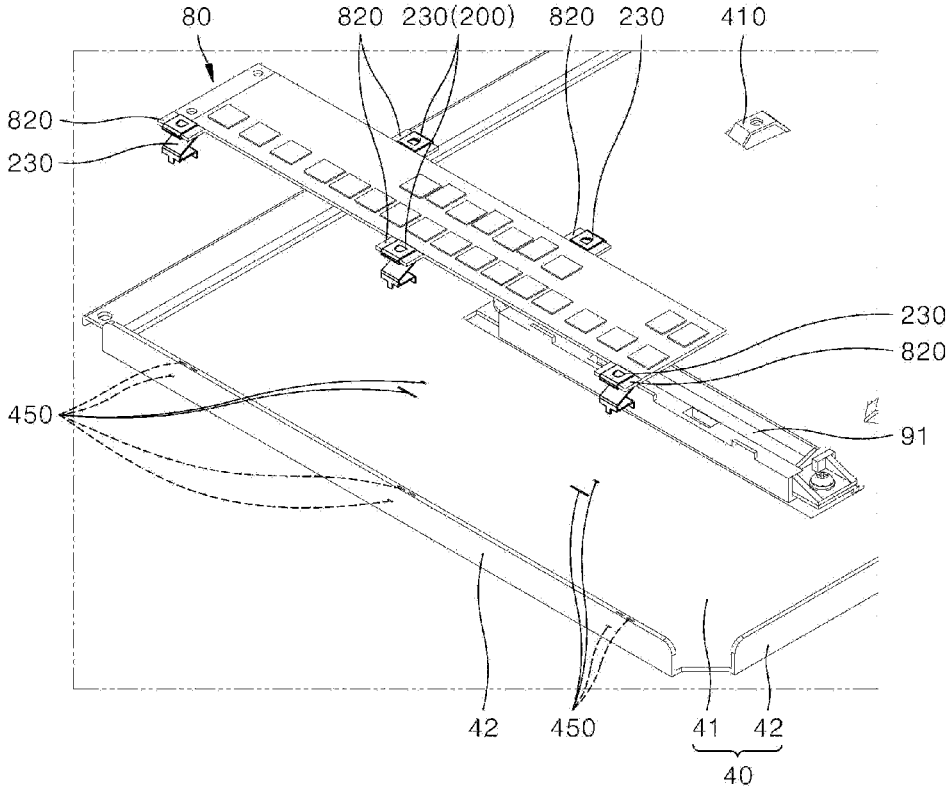
FIG. 14 is a perspective view showing another example of a coupling structure of a control board according to an embodiment of the present disclosure.

As shown in FIG. 9 and FIG. 14 described below, a plurality of mounting protrusions may protrude from a first side or edge and a second side or edge opposite the first edge of the control board 80. A corresponding number of support members 200 may be disposed on the mounting protrusions. Hereinafter, the mounting protrusions are referred to as "a first mounting protrusion 810" in one embodiment, or "a second mounting protrusion 820" according to another embodiment of the present disclosure.

Hereinafter, the support member 200 in accordance with an embodiment of the present disclosure is described in detail with reference to FIGS. 9 to 13.

Referring to FIG. 9, the control board 80 may define or include the first mounting protrusion 810 that protrudes from each of the first side or edge and the second side or edge of the control board 80. The plurality of support members 200 may be provided and the number of first mounting protrusions 810 may be the same as the number of the plurality of support members 200.

Each of the first mounting protrusion 810 may include a first mounting hole 811 to receive an upper portion of the support member 200.

The first upper plate 41 may include second mounting holes 440 at positions corresponding to the first mounting holes 811, and the second mounting holes 440 may be configured receive a lower portion of the support member 200.

Each of the support members 200 may include a rod 210 and a first elastic member 220. The rod 210 may include an upper surface that may be disposed under the control board 80 and may include a lower surface that may be disposed on the upper bracket 40. In this exemplary structure, the upper surface of the rod 210 may support or be coupled to the control board 80, and the rod 210 may be coupled to and supported by the upper bracket 40.

The first elastic member 220 may be mounted on the rod 210, and may be disposed at or near an outer circumference of the rod 210, and one end of the first elastic member 220 may contact a bottom surface of the upper bracket 40. The first elastic member 220 may be provided as, for example, a coil spring. Thus, first elastic member 220 may be configured to elastically support the rod 210.

The first elastic member 220 may be configured to apply pressure on the rod 210 and push the rod 210 upward in the vertical direction. According, the control board 80 coupled to the rod 210 may also be pushed upward and may facilitate adherence to the cover plate 20.

In some embodiments of the present disclosure, the term "adherence" does not refer only to a state or configuration in which the upper surface of the control board 80 contacts the lower surface of the cover plate 20, but also may refer to a state configuration in which the upper surface of the control board 80 is close or adjacent to the lower surface of the cover plate 20 without contacting the lower surface of the cover plate 20.

The rod 210 may include a body 211, a head 212, a first stopper 213, a second stopper 214, and a first groove 215. For example, when the rod 210 is disposed between the upper bracket 40 and the control board 80, the longitudinal or axial portion of the body 211 may be disposed in a vertical direction to provide a space between the first upper plate 41 of the upper bracket 40 and the control board 80 in the vertical direction of the electric range.

The control board 80 may be coupled to the rod 210 and may be adhered to a portion or position above the upper bracket 40 that corresponds to the cover plate 20 by the rod 210.

The head 212 may be disposed on an upper surface of the body 211 and may protrude in a direction crossing a longitudinal direction (e.g., a radial direction) of the body 211. The head 212 may protrude from the body 211 along the outer circumference of the body 211.

The first stopper 213 may be disposed under the head 212 and may extend in a direction crossing the longitudinal direction (e.g., a radial direction) of the body 211. The first stopper 213 may protrude from the body 211 along the outer circumference of the body 211.

For example, when the rod 210 is inserted into the first mounting hole 811 of the control board 80, the first stopper 213 may restrict or limit an insertion depth to block or stop the rod 210 from being deeply (e.g., greater than a predetermined length) inserted into the first mounting hole 811. The rod 210 may be coupled to the control board 80 by inserting a recess or groove between the head 212 and the first stopper 213 into the first mounting hole 811 of the control board 80.

The second stopper 214 may be disposed at a lower portion of the body 211 and may be arranged in a direction crossing the longitudinal direction (e.g., a radial direction) of the body 211. The second stopper 214 may protrude from the body 211 and may be disposed along the outer circumference of the body 211.

When the lower portion of the rod 210 is inserted into the second mounting hole 440 of the first upper plate 41, the second stopper 214 may restrict an insertion depth to block further insertion of the lower portion of the rod 210 into the second mounting hole 440.

A first groove 215 may be recessed into the body 211 from the head 212 in the longitudinal or axial direction of the body 211 and may divide the head 212 and the first stopper 213 into two sections or portions.

The head 212 may be configured to elastically deform to facilitate an easy insertion of the rod 210 into the first mounting hole 811. After the rod 210 is inserted into the first mounting hole 811, the head 212 may returned to its original shape. Accordingly, the rod 210 may be stably or fixedly inserted into the first mounting hole 811, thereby preventing or suppressing the rod 210 from being separated from the first mounting hole 811.

The first stopper 213 may define or include an elastic member mounting groove **213*a* configured to receive or attach one side of the first elastic member 220 to the rod 210. In addition, the first stopper 213 may include a hook 213*b* to inhibit or suppress separation of the first elastic member 220** attached thereon.

When the one side of the first elastic member 220 is inserted into the elastic member mounting groove **213*a* of the first stopper 213, the first elastic member 220 may be caught or held by the hook 213*b* and may be stably or fixedly disposed at an outer circumference of the first stopper 213. Subsequently, the support member 200 may be coupled to the first upper plate 41 and the control board 80 by inserting the head 212 into the first mounting hole 811 of the control board 80 and the lower portion of the rod 210 into the second mounting hole 440**.

The first elastic member 220 of the support member 200 may be configured to apply pressure to the rod 210, and the rod 210 may press or push the control board 80 to adhere or move the control board 80 to or near the cover plate 20 in a stable or secure manner (e.g., suppressing or preventing movement).

Figure 15:
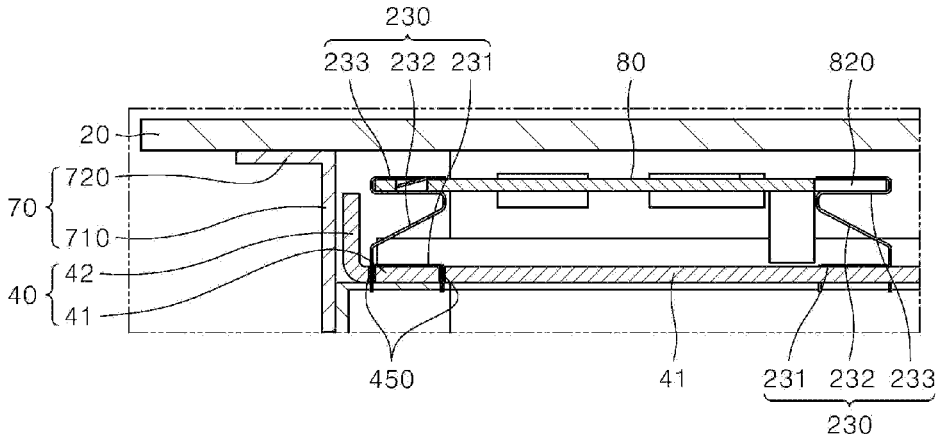
FIG. 15 is a cross-sectional view of the coupling structure of the control board according to an embodiment shown in in FIG. 14.
Figure 16:
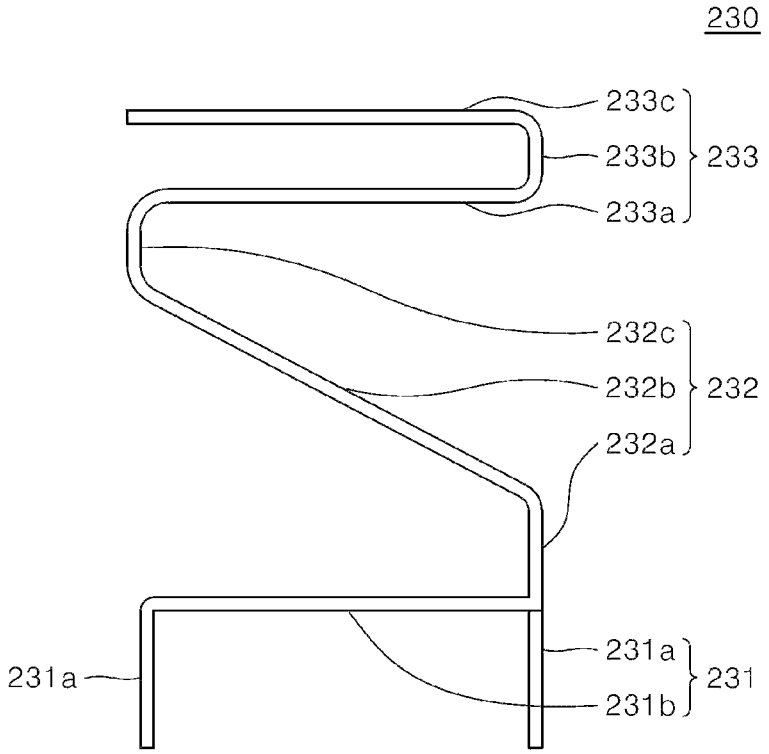
FIG. 16 is a cross-sectional view of an example second elastic member according to an embodiment of the present disclosure.

Hereinafter, another embodiment of the support member 200 is described in detail with reference to FIGS. 14 to 16.

FIG. 14 is a perspective view showing another example of coupling structure of the control board 80. FIG. 15 is a cross-sectional view of the coupling structure of the control board 80 in FIG. 14. FIG. 16 is a cross-sectional view of an example second elastic member 230.

The support member 200 according to another embodiment may include a second elastic member 230 that may be include at least a portion that is partially elastic and may be integrally formed.

In one embodiment, a plurality of second elastic members 230 may be provided. The control board 80 may define or include a plurality of second mounting protrusion 820 that protrude from a first side and a second side opposite the first side of the control board 80. In one embodiment, the number of second mounting protrusions 820 may be the same as the number of second elastic members 230.

A first side of the second elastic member 230 may be disposed under the control board 80 and a second side of the second elastic member 230 may be disposed on the first upper plate 41 of the upper bracket 40. The second elastic member 230 may be configured to elastically support the control board 80. The second elastic member 230 may be configured to apply pressure to the control board 80 to adhere the control board 80 to the cover plate 20 in a stable or secure manner (e.g., suppressing or preventing movement).

The first upper plate 41 of the upper bracket 40 may include a through-hole 450 configured to receive the second elastic member 230. The second elastic member 230 may include a first mounting portion 231 configured to be mounted on the upper bracket 40. The first mounting portion 231 may include a pair of first cells 231*a*. The first cells 231*a* may be inserted into the through-hole 450. Accordingly, a pair of through-holes 450 may be provided. That is, the pair of through-holes 450 may be defined or disposed on the first upper plate 41. The number of the pairs of through-holes 450 may correspond with the number of the second elastic members 230.

The second elastic member 230 may include a first mounting portion 231, an elastically deforming portion 232, and a second mounting portion 233. The first mounting portion 231 may be inserted into the through-hole 450 of the upper bracket 40 and may include the first cell 231*a* and a second cell 231*b*.

The pair of first cells 231*a* may be provided and a first and second sides of the pair of first cells 231*a* may be inserted into the through-hole 450. The second cell 231*b* may connect the second side to the first side of the pair of first cells 231*a*.

The elastically deforming portion 232 may be connected to the first mounting portion 231 and may have at least one bending portion. The elastically deforming portion 232 of the second elastic member 230 may be elastically deformed, and may elastically support the control board 80 by an elastic force or resistance of the elastically deforming portion 232. The elastically deforming portion 232 may include a first piece 232*a*, a second piece 232*b*, and a third piece 232*c*.

The first piece 232*a* may be connected to one side of the second cell 231*b*. The second piece 232*b* may have a first side connected to a second side of the first piece 232*a* and may be bent in a direction inclined from the first piece 232*a*. The third piece 232*c* may have a first side connected to a second side of the second piece 232*b* and may be bent from the second piece 232*b* in a direction parallel to the first piece 232*a*.

The second mounting portion 233 may be connected to the elastically deforming portion 232 and may be disposed at an end (i.e., the second mounting protrusion 820) of the control board 80. The second mounting protrusion 820 may not include a hole for additional coupling. The second mounting portion 233 may be coupled to the second mounting protrusion 820 by shape fitting or press fitting.

The second mounting portion 233 may include a first strip 233*a*, a second strip 233*b*, and a third strip 233*c*. The first strip 233*a* may be bent from the third piece 232*c* in a horizontal direction. The second strip 233*b* may be bent from the first strip 233*a* in a vertical direction. The third strip 233*c* may be bent from the second strip 233*b* in the horizontal direction.

That is, the first strip 233*a*, the second strip 233*b*, and the third strip 233*c* may have a U-shape and may be coupled to the second mounting protrusion 820 that protrudes from the end of the control board 80.

For example, when the second mounting portion 233 is disposed on the control board 80, the first strip 233*a* may be disposed under the control board 80, the second strip 233*b* may be disposed at a side of the control board 80, and the third strip 233*c* may be disposed on top of control board 80.

In one embodiment, the support member 200 may adhere the control board 80 to the cover plate 20 disposed above the upper bracket 40, thereby providing a sufficient air flow space under the control board 80. With the air flow space, heat applied to the control board 80 may be effectively cooled.

In an embodiment, the support member 200 may stably or securely adhere the control board 80 to the cover plate 20.

Figure 17:
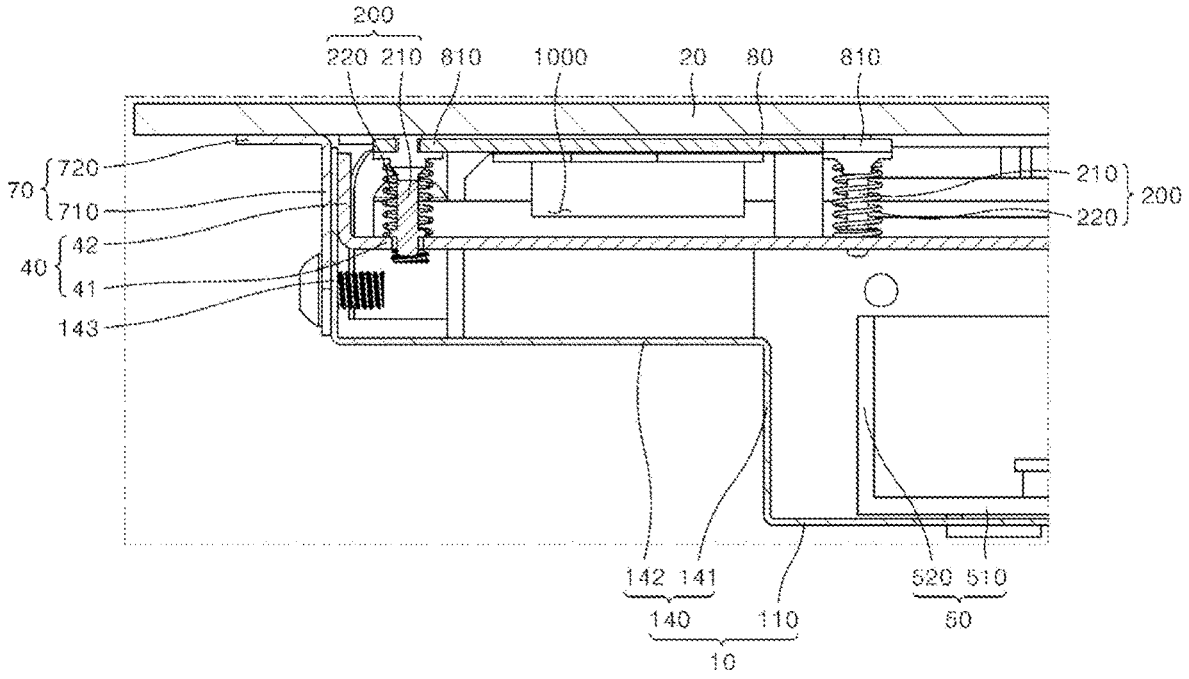
FIG. 17 is a cross-sectional view of another example of portion of an electric range according to an embodiment of the present disclosure.

FIG. 17 is a cross-sectional view of another example of portion of an electric range of the present disclosure. A case 10 according to an embodiment of the electric range may further include a protruding casing 140.

The protruding casing 140 may be disposed at a front side of the electric range. The protruding casing 140 may extend from the first casing 110 and may define an arrangement space 1000 to accommodate at least a portion of the control board 80.

The protruding casing 140 may include a first bending portion 141, a second bending portion 142, and a third bending portion 143. The first bending portion 141 may be bent from the first casing 110 and may face upward.

The second bending portion 142 may be bent from the first bending portion 141 and may face forward. The third bending portion 143 may be bent from the second bending portion 142 and may face upward.

In this structure, the second bending portion 142 and the third bending portion 143 may define the arrangement space 1000. The arrangement space 1000 may protrude from the case 10 toward the front of the electric range and may be slimmer or narrower than other internal spaces of the case 10.

The control board 80 may be spaced apart from a heating portion by disposing at least a portion of the control board 80 in the arrangement space 1000, thereby suppressing transfer of heat generated by the heating portion to the control board 80.

In addition, the arrangement space 1000 may be slimmer or narrower than the remaining inner space of the case 10 such that the heat transfer to the control board 80 through the inner space of the case 10 may be effectively suppressed or reduced.

In addition, the control board 80 is disposed on the arrangement space 1000 and air smoothly flows at a lower portion of the arrangement space 1000, thereby effectively cooling the control board 80.

In addition, the second bending portion 142 and the third bending portion 143 may be bent with respect to each other, thereby increasing an externally exposed area of the arrangement space 1000, thereby providing a heat dissipation area that may effectively cool the control board 80.

The present disclosure has been described with reference to drawings hereinabove; however, the present disclosure is not limited to the embodiments and the exemplary drawings herein, and various modifications may be made by the skilled person in the art within the scope of the technical idea of the present disclosure. Further, even if working effects obtained based on the configurations of the present disclosure are not explicitly described in the description of embodiments of the present disclosure, effects predictable based on the corresponding configuration have to be recognized.

What is claimed is:

1. An electric range, comprising:

a case;

a cover plate coupled to an upper surface of the case to receive an object;

a plurality of heating portions disposed under the cover plate to heat the object;

an upper bracket disposed under the plurality of heating portions to support the plurality of heating portions;

a control board disposed between the cover plate and the upper bracket;

a support member having a first end disposed under the control board and a second end disposed on the upper bracket to support the control board;

a base bracket disposed under the upper bracket, and a printed circuit board disposed on the base bracket, wherein the control board comprises a mounting protrusion protruding from a first side or a second side of the control board.

2. The electric range of claim 1, further comprising a plurality of support members, wherein the control board comprises a plurality of mounting protrusions protruding from the first side and the second side of the control board, and wherein each of the plurality of mounting protrusions comprises a first mounting hole to receive an upper portion of each of the plurality of support members.

3. The electric range of claim 2, wherein the upper bracket comprises:

a first upper plate that forms a bottom surface of the upper bracket; and a second upper plate bent from an edge of the first upper plate, wherein the first upper plate comprises a second mounting hole disposed at a position corresponding to the first mounting hole, the second mounting hole receiving a lower portion of at least one of the plurality of support members.

4. The electric range of claim 3, wherein each of the plurality of support members comprises:

a rod having an upper surface disposed under the control board and a lower surface disposed on the upper bracket; and an elastic member disposed on the rod, wherein the elastic member is disposed about a circumference of the rod, and wherein the elastic member comprises one side contacting the bottom surface of the upper bracket.

5. The electric range of claim 4, wherein the elastic member comprises a coil spring.

6. The electric range of claim 4, wherein the rod further comprises:

a body;

a head disposed on the body, the head protruding in a radial direction of the body;

a first stopper disposed below the head and arranged in the radial direction of the body;

a second stopper disposed at a lower portion of the body and arranged in the radial direction of the body; and a first groove formed by a recessed portion of the body in an axial direction of the body, the recessed portion being formed from the head to the body to divide the head and the first stopper into multiple parts.

7. The electric range of claim 6, wherein the first stopper comprises an elastic member mounting groove to receive one end of the elastic member.

8. The electric range of claim 7, wherein the first stopper comprises a hook coupled to the elastic member.

9. An electric range, comprising:

a case;

a cover plate coupled to an upper surface of the case to receive an object;

a plurality of heating portions disposed under the cover plate to heat the object;

an upper bracket disposed under the plurality of heating portions to support the plurality of heating portions;

a control board disposed between the cover plate and the upper bracket;

a support member having a first end disposed under the control board and a second end disposed on the upper bracket to support the control board;

a base bracket disposed under the upper bracket, and a printed circuit board disposed on the base bracket, wherein the support member comprises an elastic member, the elastic member comprises:

a first mounting portion received in a through-hole of the upper bracket;

an elastically deforming portion connected to the first mounting portion, the elastically deforming portion having at least one bending portion, and a second mounting portion connected to the elastically deforming portion, the second mounting portion being disposed adjacent to an end of the control board.

10. The electric range of claim 9, wherein the first mounting portion comprises:

a pair of first cells having a first side received in the through-hole; and a second cell connected to a second side of the pair of first cells.

11. The electric range of claim 10, wherein the elastically deforming portion comprises:

a first piece connected to one side of the second cell;

a second piece having a first side connected to a second side of the first piece, the second piece being bent in an inclined direction from the first piece; and a third piece having one end connected to the second side of the second piece, the third piece being bent from the second piece in a direction parallel to the first piece.

12. The electric range of claim 11, wherein the second mounting portion comprises:

a first strip bent from the third piece in a horizontal direction;

a second strip bent from the first strip in a vertical direction; and a third strip bent from the second strip in the horizontal direction.

13. The electric range of claim 12, wherein the first strip is disposed under the control board, wherein the second strip is disposed adjacent to a side of the control board, and wherein the third strip is disposed above the control board.

14. The electric range of claim 9, further comprising:

a plurality of elastic members, wherein the control board comprises a plurality of mounting protrusions, the plurality of mounting protrusions protruding from a first side and a second side of the control board receive the second mounting portion.

15. The electric range of claim 1, wherein the case comprises:

a first casing forming a bottom surface of the case; and a protruding casing that extends from the first casing and defining an arrangement space to receive at least a portion of the control board, wherein the protruding casing comprises:

a first bending portion bent from the first casing in a vertical direction;

a second bending portion bent from the first bending portion a horizontal direction; and a third bending portion bent from the second bending portion in the vertical direction.

16. An electric range, comprising:

a case;

a cover plate coupled to an upper surface of the case to receive an object;

a plurality of heating portions disposed below the cover plate to heat the object;

an upper bracket disposed under the plurality of heating portions to support the plurality of heating portions;

a control board disposed between the cover plate and the upper bracket; and a support member to support the control board, the support member having a first side disposed under the control board, a second side disposed on the upper bracket, wherein the control board comprises a mounting protrusion protruding from a first side or a second side of the control board.

17. The electric range of claim 16, further comprising:

a plurality of support members, wherein the control board comprises a plurality of mounting protrusions that protrudes from the first side of the control board and the second side of the control board, a number of the plurality of mounting protrusions corresponding to a number of the plurality of support members.

18. The electric range of claim 9, wherein the first mounting portion, the elastically deforming portion, and the second mounting portion are integrated together to form the elastic member.

19. The electric range of claim 4, wherein the elastic member is a spring.

* * * * *